US005830632A

United States Patent [19]

Chari et al.

[11] Patent Number: 5,830,632

[45] Date of Patent: Nov. 3, 1998

[54] PHOTOGRAPHIC ELEMENT CONTAINING DISPERSIONS OF HIGH DYE-YIELD COUPLERS HAVING IMPROVED PHOTOGRAPHIC ACTIVITY

[75] Inventors: Krishnan Chari, Fairport; David Thomas Southby; David Hoke, both of Rochester, all of N.Y.

[73] Assignee: Eastman Kodak Company, Rochester, N.Y.

[21] Appl. No.: 741,886

[22] Filed: Oct. 31, 1996

[51] Int. Cl.[6] ..... G03C 1/08; G03C 7/26; G03C 7/32

[52] U.S. Cl. ..... 430/546; 430/377; 430/359; 430/226; 430/545; 430/549; 430/559; 430/955; 430/627; 430/631; 430/935

[58] Field of Search ..... 430/377, 545, 430/546, 627, 631, 935, 359, 226, 549, 559, 955

[56] References Cited

U.S. PATENT DOCUMENTS

| | | | |
|---|---|---|---|
| 2,322,027 | 6/1943 | Jelley et al. | 95/7 |
| 2,787,544 | 4/1957 | Godowsky et al. | 96/97 |
| 2,801,170 | 7/1957 | Vittum et al. | 96/97 |
| 2,870,012 | 1/1959 | Godowsky et al. | 96/97 |
| 4,199,363 | 4/1980 | Chen | 430/512 |
| 4,388,403 | 6/1983 | Helling et al. | 430/546 |
| 4,840,884 | 6/1989 | Mooberry et al. | 430/557 |
| 4,957,857 | 9/1990 | Chari | 430/546 |
| 5,008,179 | 4/1991 | Chari et al. | 430/546 |
| 5,173,398 | 12/1992 | Fukazawa et al. | 430/546 |
| 5,447,819 | 9/1995 | Mooberry et al. | 430/226 |
| 5,457,004 | 10/1995 | Mooberry et al. | 430/226 |

FOREIGN PATENT DOCUMENTS 1193349 5/1970 United Kingdom .

OTHER PUBLICATIONS

Research Disclosure No. 16468, Dec. 1977, pp. 75–80.

*Primary Examiner*—Geraldine Letscher
*Attorney, Agent, or Firm*—Andrew J. Anderson

[57] ABSTRACT

Photographic element are described comprising a support bearing a photographic silver halide emulsion layer having associated therewith a micro-precipitated dispersion of a high dye-yield coupler having the formula:

$$\text{COUP—(T)}_m\text{—L—DYE}$$

where COUP is the coupler moiety of the coupler capable of reacting at the coupling position with oxidized color developer to form a first dye, T is one or more timing groups with m=0, 1 or 2, L is a linking group selected from the group consisting of —OC(O)—, —OC(S)—, —SC(O)—, —SC(S)—, or —OC(=$NSO_2R$)—, where R is a substituted or unsubstituted alkyl or aryl group, and DYE is a second dye or precursor thereof comprising an electrically neutral chromophore. The invention also provides a photographic coupler dispersion, a photographic silver halide emulsion, and a process for forming an image in a photographic element in accordance with the invention. The photographic element, coupler dispersion, silver halide emulsion, and imaging process provide improved reactivity and photographic properties.

18 Claims, 2 Drawing Sheets

PHOTOGRAPHIC ELEMENT CONTAINING DISPERSIONS OF HIGH DYE-YIELD COUPLERS HAVING IMPROVED PHOTOGRAPHIC ACTIVITY

FIELD OF THE INVENTION

This invention relates to photographic coupler dispersions, and photographic elements and emulsion layers containing such dispersions, which exhibit improved activity. More particularly, this invention relates to microprecipitated dispersions of high dye-yield couplers and photographic elements and emulsion layers containing such dispersions.

BACKGROUND OF THE INVENTION

Photographic couplers which contain a coupling-off group that releases a dye or dye precursor during photographic processing, in addition to forming a separate dye upon reaction with oxidized color developer, have been previously described in the photographic art. Such couplers can be described as high dye yield, or "one-equivalent" couplers, because theoretically the ratio of dye molecules produced to molecules of silver halide reduced in the photographic development process is one. While various high dye yield couplers have been previously described which release dyes comprising anionic or electrically neutral chromophores, high dye yield couplers which form dyes comprising electrically neutral chromophores are particularly useful, as ionic dyes require the presence of a mordant to stabilize the released ionic dye, and such mordants can lead to undesired effects such as stain caused by retained sensitizing dyes. Particularly useful high dye yield couplers are disclosed, e.g., in U.S. Pat. Nos. 4,840,884, 5,447,819, and 5,457,004, the disclosures of which are hereby incorporated by reference herein. Such couplers are generally incorporated into photographic elements in the form of conventional homogenized dispersions of organic solvent solutions. The conventional "oil in water" dispersion method for incorporating hydrophobic couplers is described, e.g., in U.S. Pat. No. 2,322,027 by Jelly and Vittum. The coupler is dissolved in a high boiling water immiscible solvent, mixed with aqueous gelatin, and dispersed using a colloid mill or homogenizer. The dispersion is then typically chill set and stored under refrigeration.

Frequently, the combination of coupler and solvent has to be heated to a high temperature in order to dissolve the coupler. In some instances the coupler may crystallize subsequently upon chill setting and storage of the dispersion. In designing formulations, considerable effort has to be made to select a coupler solvent so that the coupler does not crystallize. The process also suffers from the disadvantage that a large amount of energy has to be expended to generate the high shearing forces needed in milling or homogenization in order to minimize particle size. Additionally, the minimum particle sizes generally obtainable even at the highest shearing forces is usually limited to greater than 0.1 micron. Further, it has been found that use of conventional solvent dispersions of high dye yield couplers in photographic elements may not always be satisfactory from the standpoint of photographic activity.

It is generally desirable to minimize the dry thickness of the coated layers in the design of silver halide light-sensitive multilayer photographic materials. Layer thinning is advantageous for reasons such as improved image sharpness due to reduced light scattering during exposure and increased developability due to shorter diffusion paths through the multilayer structure. This increase in developability can lead to lower silver and/or coupler coated levels, hence lower materials cost. In order to reduce the coated thickness of photographic layers, it is essential to minimize the amount of permanent coupler solvent coated in the element. In fact, reductions in coupler solvent level also afford concomitant reductions in gelatin level which leads to further reductions in coated dry thickness. U.S. Pat. No. 5,173,398, e.g., discloses photographic elements with coupler-containing layers having substantially no high-boiling solvent, wherein the couplers are incorporated in the layer in the form of precipitated dispersions. However, coupler solvent reduction can also result in reducing the reactivity of the dispersed photographically useful chemical, such as a dye-forming coupler, to a level too low to produce desired dye density upon processing of the photographic material.

The art of precipitation of hydrophobic coupler for photographic systems, starting from a solution state, to fine particle colloidal dispersions is known. This is generally achieved by dissolving the coupler in a water-miscible solvent aided by addition of base to ionize the coupler, addition of a surfactant with subsequent precipitation of the couplers by lowering the pH, or by shift in concentration of the two or more miscible solvents, such that the coupler is no longer soluble in the continuous phase and precipitates as a fine colloidal dispersion. United Kingdom Patent 1,193,349 of Townsley et al., U.S. Pat. No. 2,870,012 of Godowsky et al., U.S. Pat. No. 4,388,403 of Helling et al., U.S. Pat. No. 4,957,857 of Chani, U.S. Pat. No. 5,008,179 of Chari et al., and *Research Disclosure* 16468, December 1977, pages 75–80 entitled "Process for Preparing Stable Aqueous Dispersions of Certain Hydrophobic Materials" by W. J. Priest, published by Industrial Opportunities Ltd., The Old Harbormaster's, 8 North Street Emsworth, Hants P 010 7DD U.K., e.g., disclose various techniques for forming precipitated coupler dispersions, the disclosures of which are hereby incorporated by reference herein. There is no teaching or disclosure in the art, however, to use such dispersion techniques specifically for high dye yield couplers, nor any suggestion of the unique and unexpected combination of advantages which may be obtained from the use of microprecipitated dispersions of high dye-yield couplers which release a dye comprising a neutral chromophore in photographic elements.

It is a problem to be solved to provide photographic elements, emulsion layers, coupler dispersions and imaging processes which comprise dye forming high dye-yield couplers, which have improved activity and photographic properties, without requiring the use of a mordant to stabilize released ionic dyes. It would be particularly desirable to obtain active, stable dispersions of such couplers in the absence of significant amounts of permanent solvent, water soluble polymers, and/or polymer latexes, or with minimal addition of such materials. It would be further desirable to provide silver halide photographic elements made from such dispersions, which achieve high coupler reactivity in the photographic material to obtain good dye density upon processing. It is further desirable to achieve a reduction in the coated level of coupler solvent in photographic elements to decrease coated dry thickness. It is toward these ends that the present invention is directed.

SUMMARY OF THE INVENTION

The invention provides a photographic element comprising a support bearing a photographic silver halide emulsion layer having associated therewith a micro-precipitated dispersion of a high dye-yield coupler having the formula:

$$COUP—(T)_m—L—DYE$$

where COUP is the coupler moiety of the coupler capable of reacting at the coupling position with oxidized color developer to form a first dye, T is one or more timing groups with m=0, 1 or 2, L is a linking group selected from the group consisting of —OC(O)—, —OC(S)—, —SC(O)—, —SC(S)—, or —OC(=$NSO_2R$)—, where R is a substituted or unsubstituted alkyl or aryl group, and DYE is a second dye or precursor thereof comprising an electrically neutral chromophore.

The invention also provides a photographic coupler dispersion, a photographic silver halide emulsion, and a process for forming an image in a photographic element in accordance with the invention. The photographic element, coupler dispersion, silver halide emulsion, and imaging process provide improved reactivity and photographic properties.

DETAILED DESCRIPTION OF THE INVENTION

Figure 1:
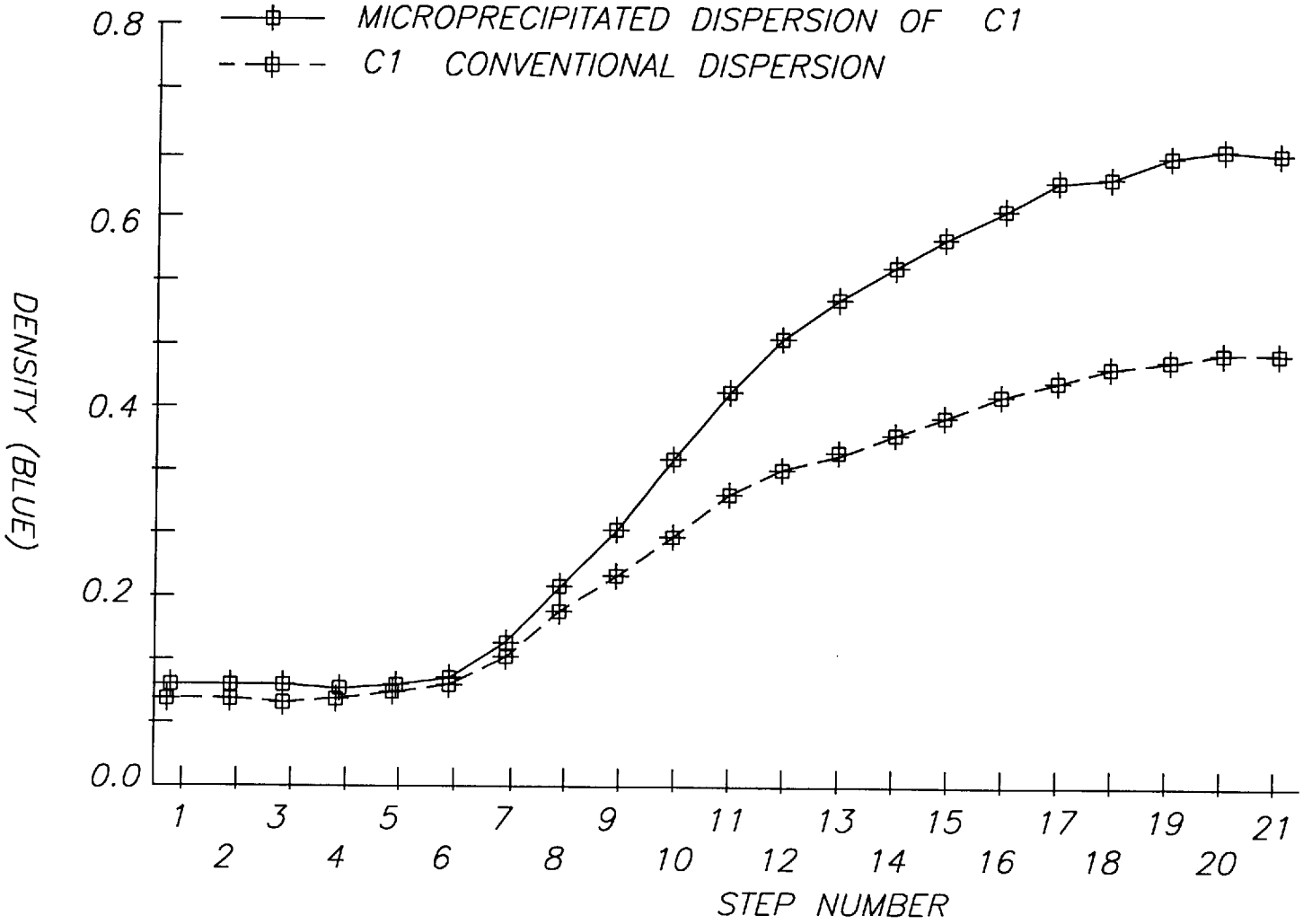
FIGS. 1 and 2 depict the sesitometric curves resulting from Examples 1 and 2, respectively, for photographic elements containing microprecipitated coupler dispersions in accordance with the invention versus elements containing conventional oil-in-water coupler dispersions.

The dye forming coupler in the dispersions and elements of the invention has the general formula:

$$COUP—(T)_m—L—DYE$$

where COUP is coupler moiety of a photographic coupler capable of reacting at the coupling position with oxidized color developer to form a first dye, and -$(T)_m$-L-DYE or -L-DYE (when m is 0) represents a coupling-off group bonded to COUP at the coupling position.

The coupler moiety COUP can be any moiety which will react with oxidized color developing agent to cleave the bond between the linking group L or timing group T and COUP. It includes coupler moieties employed in conventional color-forming couplers which yield colorless products on reaction with oxidized color developing agents as well as coupler moieties which yield colored products on reaction with oxidized color developing agents. Both types of such coupler moieties are well known in the art. The coupler moiety can be unballasted or ballasted with an oil-soluble or fat-tail group. It can be monomeric, or it can form part of a dimeric, oligomeric or polymeric coupler, in which case more than one coupling-off group can be contained in the coupler. Depending upon the particular coupler moiety, the particular color developing agent and the type of processing, the reaction product of the coupler moiety and oxidized color developing agent can be colored and nondiffusible (in which case it will remain in the location where it is formed), colored and diffusible (in which case it may be removed during processing from the location where it is formed or allowed to migrate to a different location), or colorless.

Preferably, COUP represents an image dye-forming coupler moiety which forms an image dye upon reacting with oxidized developer, such as a cyan, magenta, yellow or black image dye.

Coupler moieties that form cyan dyes upon reaction with oxidized color developing agents which may be used in accordance with the invention are described, e.g., in such representative patents and publications as: U.S. Patent Nos. 2,367,531; 2,423,730; 2,474,293; 2,772,162; 2,895,826; 3,002,836; 3,034,892; 3,041,236; 4,333,999; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan dye forming coupler moieties described in, for instance, European Patent Application Nos. 544,322; 556,700; 556,777; 565,096; 570,006; and 574,948.

Coupler moieties that form magenta dyes upon reaction with oxidized color developing agent which may be used in accordance with the invention are described, e.g., in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band II1, pp. 126–156 (1961). Preferably such couplers are pyrazolones, pyrazolotriazoles, or pyrazolobenzimidazoles that form magenta dyes upon reaction with oxidized color developing agents. Preferred coupler moieties include 1H-pyrazolo [5,1-c]-1,2,4-triazoles and 1H-pyrazolo [1,5-b] -1,2,4-triazoles. Examples of 1H-pyrazolo [5,1-c]- 1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]- 1,2,4-triazoles can be found in European Patent applications 176,804; 177,765; U.S. Pat. Nos. 4,659,652; 5,066,575; and 5,250,400. Especially preferred are pyrazolone couplers, such as described in U.S. Pat. No. 4,853,319.

Coupler moieties that form yellow dyes upon reaction with oxidized color developing agent which may be used in accordance with the invention are described, e.g., in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds. Also preferred are yellow coupler moieties such as described in, for example, European Patent Application Nos. 482,552; 510,535; 524,540; 543,367; and U.S. Pat. No. 5,238,803.

Coupler moieties that form colorless products upon reaction with oxidized color developing agent which may be used in accordance with the invention are described, e.g., in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Coupler moieties that form black dyes upon reaction with oxidized color developing agent which may be used in accordance with the invention are described, e.g., in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

T is a timing group which, as indicated by the value range for m of from 0 to 2, may be absent or may represent one or two such timing groups. Such groups are well-known in the art such as (1) groups utilizing the cleavage reaction of a hemiacetal (U.S. Pat. No. 4,146,396, Japanese Applications 60-249148; 60-249149); (2) groups utilizing an electron transfer reaction along a conjugated system (U.S. Pat. No. 4,409,323; 4,421,845; Japanese Applications 57-188035;

58-98728; 58-209736; 58-209738); (3) groups utilizing the cleavage of imino ketals (U.S. Pat. No. 4,546,073); (4) groups that function as a coupler or reducing agent after the coupler reaction (U.S. Pat. Nos. 4,438,193; 4,618,571); and (5) groups using an intramolecular nucleophilic substitution reaction (U.S. Pat. No. 4,248,962). The timing group to which the L-DYE group of the invention is optionally attached is any one which will permit release of the L-DYE group. Foregoing group (5) is not suitable as the group to release L-DYE but could serve as the first of a sequence of two timing groups. Other timing groups are generally suitable for releasing -L-DYE. The couplers of the invention may include a solubilizing substituent on the timing group T as disclosed, e.g., in U.S. Pat. No. 5,447,819 referenced above.

Timing groups as described under (2) above and the listed patents are most suitable. Generally these consist of a bond from COUP or another timing group to an oxygen atom which is bonded to a substituted or unsubstituted aromatic hydrocarbyl or heterocyclic ring at a location in conjugation with a methyl group on the ring which may optionally be substituted with one or two alkyl groups, where the methyl group is bonded to L-DYE or a second timing group. A typical such group based on an aromatic hydrocarbyl group has the formula:

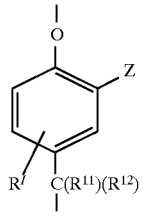

wherein Z is selected from the group consisting of nitro, cyano, alkylsulfonyl; sulfamoyl ($—SO_2NR_2$); and sulfonamido ($—NRSO_2R$) groups; R is hydrogen or a substituent such as an alkyl group; $R^I$, $R^{11}$ and $R^{12}$ are independently hydrogen or substituents that do not adversely affect the coupling and release reactions or the properties of the dyes formed thereby.

One example of such a group containing an aromatic heterocycle is:

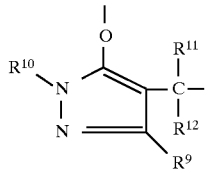

where $R^9$ through $R^{12}$ are independently hydrogen or substituents that do not adversely affect the coupling and release reactions or the properties of the dyes formed thereby.

L is a group which serves to connect COUP or T to the second dye.

L has a formula so as to permit -L-DYE or $-(T)_m$-L-DYE to be cleaved from the coupler upon the coupler's oxidative coupling with color developer during development processing. COUP combines with the oxidized developer to form the first dye and the fragment -L-DYE or $-(T)_m$-L-DYE is then freed from COUP. Suitable groups for L are —OC(O)—, —OC(S)—, —SC(O)—, —SC(S)—, or —OC(=$NSO_2R$)—, where R is substituted or unsubstituted alkyl or aryl group. Such groups permit the cleavage of the fragment from COUP and are cleaved from DYE.

The coupler of the invention releases DYE, a second dye or precursor thereof having an electrically neutral chromophore. By this is meant that the dye chromophore at its characteristic hue bears no formal electrical charge. Such electrically neutral dyes enable dye hue stabilization without requiring mordanting the dye formed. DYE suitably contains a substituted nitrogen group —$NR^1$— which is bonded to the linking group L. Such dyes may be any of the types disclosed, for example, in the aforementioned U.S. Pat. No. 4,840,884, 5,447,819, and 5,457,004 and may be synthesized as described therein. In U.S. Pat. No. 4,840,884, the term DYE is defined so that the —$NR^1$— group is not a part of DYE, 10 while the definition herein does include such group. In either case. the composition of the dye formed by release is the same.

The $R^1$ substituent on —$NR^1$— can be any substituent that does not adversely affect the coupler. When the —$NR^1$— is part of an auxochrome, $R^1$ can be, for example, hydrogen or a substituted or unsubstituted alkyl group, such as alkyl containing 1 to 42 carbon atoms, including methyl, ethyl, propyl, n-butyl. t-butyl or eicosyl, or a substituted or unsubstituted aryl group (including heteroaryl), such as phenyl. When the nitrogen atom attached to L is part of a chromophore, $R^1$ becomes an integral part of the chromophore. Preferred $R^1$ groups are alkyl, such as alkyl containing 1 to 18 carbon atoms when $R^1$ is part of the dye auxochrome. $R^1$ when part of the chromophore is, for example, unsubstituted or substituted aryl, such as phenyl.

Useful classes of DYE moieties include:

I. Azo dye moieties including the —$NR^1$— group represented by the structure:

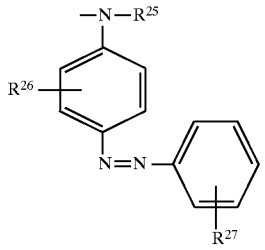

wherein $R^{25}$ is hydrogen or a substituent, such as alkyl and $R^{26}$ and $R^{27}$ independently represent hydrogen or one or more substituents such as alkyl.

II. Azamethine dye moieties including the —$NR^1$— group represented by the structure:

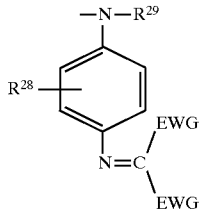

wherein $R^{28}$ is hydrogen or one or more substituents, such as alkyl; $R^{29}$ is hydrogen or a substituent, such as alkyl; and EWG is an electron withdrawing group.

III. Methine dye moieties including the —$NR^1$— group represented by the structure:

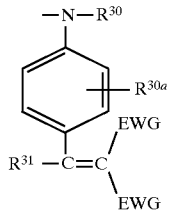

wherein $R^{30}$ and $R^{31}$ are independently hydrogen or a substituent, such as alkyl; $R^{30a}$ is hydrogen or one or more substituents such as alkyl; and EWG is an electron withdrawing group having a positive Hammett's sigma(para) value.

The term DYE also includes dye precursors wherein the described substituted nitrogen atom is an integral part of the chromophore, also described herein as leuco dye moieties. Such dye precursors include, for example:

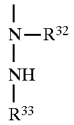

wherein $R^{32}$ is a group that is cleaved during processing to leave NH, or N=N, and $R^{33}$ is aryl, such as substituted phenyl.

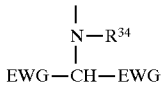

wherein $R^{34}$ is a group that is cleaved during processing to leave NH or N=C; and EWG is an electron withdrawing group as defined above.

Particularly suitable for use in the present invention are high dye yield couplers as described in U.S. Pat. No. 5,457,004 incorporated by reference above. where DYE has the formula:

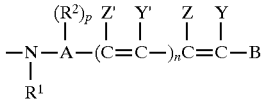

$R^1$ is hydrogen or a substituted or unsubstituted alkyl or aryl (including heteroaryl) group. The $R^1$ substituent can be any substituent that does not adversely affect the coupler. $R^1$ can be, for example, hydrogen or alkyl, such as alkyl containing 1 to 42, typically 1 to 22 carbon atoms. Preferred $R^1$ groups are unsubstituted or substituted alky, such as alkyl containing 1 to 18 carbon atoms or unsubstituted or substituted aryl, such as phenyl. Suitably, $R^1$ may be methyl, ethyl, propyl, butyl, pentyl, docecyl etc. Cyclic or branched alkyl groups such as isopropyl, cyclopentyl or cyclohexyl have been found advantageous as have alkyl groups of 1 to 5 carbon atoms.

A is a substituted or unsubstituted aryl (including heteroaryl) ring containing up to three optional substituents $R^2$. Suitably, A is a phenyl, naphthyl, or thiazole ring. Each $R^2$ is independently a substituted or unsubstituted alkyl group which may form a ring with Z', and p is an integer from 0 to 3. One or more $R^2$ substituents may be present which preferably include alkyl groups of from 1 to 5 carbon atoms such as a methyl or propyl group.

Each Z, Z', and Y' is independently hydrogen or a substituent. Y is an electron withdrawing group. By electron withdrawing it is meant that the Hammett's sigma(para) constant value for Y is greater than zero. Constant values for various substituents are provided in Hansch and Leo, *Substituent Constants for Correlation Analysis in Chemistry and Biology*, Wiley, New York, 1979. Preferably, Y is a substituent having a Hammett's sigma(para) constant value of at least 0.3 and most preferably at least 0.4. Suitable examples are cyano, carboxyl, sulfonyl, and acyl groups.

n, which represents the number of conjugated vinyl groups and affects the hue of the dye, is 0, 1, or 2.

B is a heterocycle having the formula:

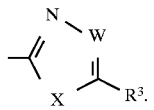

X is O, S, or $N(R^5)$ where $R^5$ is hydrogen or alkyl of up to 22 carbon atoms. Most suitably, X is O. W is N or $C(R^4)$ where $R^4$ is hydrogen or a substituent. $R^3$ is a substituent linked to the heterocycle by a carbon or nitrogen atom of the substituent. Suitably, $R^3$ is a substituted or unsubstituted alkyl or aryl group. If desired, $R^3$ and $R^4$ may be linked to form a ring. It is provided that $R^3$ and $R^4$ may be linked to form a ring and provided further that when $R^3$ and $R^4$ form a phenyl ring, Z is hydrogen, W is $C(R^4)$, and X is oxygen, the phenyl ring does not contain a substituent having a Hammett's sigma(para) value of 0.23 or more. The strong electron withdrawing power of such combination is believed responsible for the instability of couplers bearing such a combination of substituents.

When $R^3$ and $R^4$ form a ring, a substituted or unsubstituted ring, particularly an aromatic ring, may be employed. Phenyl and naphthyl rings are examples. The ring may suitably contain one or more substituents of up to 20 carbon atoms each such as alkyl groups, e.g. methyl, i-propyl, t-butyl etc.

In a preferred embodiment, X is O, W is $C(R^4)$, and $R^3$ and $R^4$ form a phenyl ring so that B is a benzoxazole group.

In order to take advantage of the high dye yield potential of the above described couplers, in a preferred embodiment of the invention COUP represents a ballasted image dye-forming coupler moiety which forms a ballasted image dye upon reacting with oxidized developer, such as a cyan, magenta, yellow or black image dye, and DYE represents a ballasted dye which has a $\lambda_{max}$ within 25 nm of the $\lambda_{max}$ of the dye formed upon reaction of COUP with oxidized color developer, wherein $\lambda_{max}$ represents the wavelength of maximum light absorbance of the dye, in order to provide two image dyes having essentially the same hue upon reaction with oxidized color developer. In such instances, COUP is most suitably capable of forming a yellow dye when coupled with oxidized color developer. Yellow dyes are generally most readily shifted outside the visible region by the linking group and therefore the formation of two yellow dye molecules from the coupler is attractive. Further, extinctions of conventional yellow dyes are less than desired so the release of a high extinction yellow dye would serve to greatly improve the density obtainable. Methine chromophores are preferred for DYE over azo's for reasons of higher molar extinction which means less dye weight-wise is needed, narrower bandwidth and better curve shape (better hue, truer color), and less undesired color in the shifted form when attached to the parent coupler.

As used herein, the term substituent, unless otherwise specifically stated, is intended to generally refer to photographically acceptable substituent groups. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, .sec-butoxy, hexyloxy, 2-ethylhexyloxy, tetradecyloxy 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N- methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio, acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1(N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 42 carbon atoms and usually less than 24 carbon atoms, but greater numbers are possible depending on the particular substituents selected. Moreover, as indicated, the substituents may themselves be suitably substituted with any of the above groups.

The timing and linking groups and DYE optionally contain substituents that can modify the rate of reaction, diffusion, or displacement as known in the art. The selection of the type and size of such substituents, e.g., can be made in order to provide a partition coefficient of DYE which permits a desired degree of diffusion.

Suitable examples of high dye yield couplers, and dyes formed upon release of DYE from such couplers, for use in accordance with the present invention include those described, e.g., in U.S. Pat. Nos. 4,840,884, 5,447,819, and 5,457,004, incorporated by reference above. Particularly suitable couplers containing a methine dye chromophore are described in U.S. Pat. No. 5,457.004.

Processes for forming microprecipitated dispersions of hydrophobic couplers for photographic systems in accordance with the invention generally comprise dissolving the coupler in a basic solvent medium, typically comprising aqueous base and a water-miscible auxiliary solvent such as propanol (with heating and stirring), addition of a surfactant, and subsequent precipitation of the couplers by addition of an acid to lower the pH, or by shift in concentration of two or more miscible solvents, such that the coupler is no longer soluble in the continuous phase and precipitates as a fine colloidal dispersion as discussed above in the Background of the Invention. The dispersion after pH and solvent shift is then washed to remove the solvent. The washed coupler dispersion is generally storage stable without refrigeration.

A preferred process for forming micro-precipitated dispersion for use in accordance with the instant invention is disclosed in U.S. Pat. No. 4,957,857 of Chari incorporated by reference above, wherein a basic solvent solution of a coupler is formed along with an aqueous solution of a nonionic water soluble polymer and ionic surfactant, and the solvent coupler solution and the aqueous solution are combined and immediately neutralized to a pH of about 6. The basic solvent normally may be made a basic solution by the addition of a base, such as sodium hydroxide, to a solvent such as an alcohol. After combination of the solvent and water solutions and neutralization or addition of acid to precipitate the dispersion of coupler particles, the dispersion may be washed using a dialysis membrane to remove the solvent.

Another preferred process for forming micro-precipitated coupler dispersions in accordance with the instant invention is described in U.S. Pat. No. 5,008,179 incorporated by reference above, wherein permanent solvent and water are combined to form a dispersion of the permanent solvent in water. An auxiliary solvent may also be present to facilitate formation of the dispersion, and may be subsequently removed by evaporation or washing. There may also be surfactants, hydrophilic colloids such as gelatin, and additional polymers present. A second dispersion of coupler, water, and surfactant is prepared by dissolving the coupler in an auxiliary solvent and surfactant, precipitating the coupler by addition of water and/or change of pH to form the dispersion, and then washing to remove the auxiliary solvent. These two dispersions, one containing the permanent water immiscible solvent and the other the coupler particles, are then mixed. Permanent solvent to coupler weight ratios of at least 0.01: 1, and more preferably at least 0.05:1 are desired to provide effective coupler activation. Permanent solvent to coupler weight ratios of less than 0.3: 1, preferably less than 0.2:1 and most preferably less than 0.15:1 are desired to minimize levels of coated materials in order to enable thin layers to be achieved.

The microprecipitated coupler dispersions in accordance with the invention generally result in dispersions having an average particle size of less than 0.1 micron, typically from 0.01 to 0.05 micron, and most typically about 0.02 micron. Such dispersion particle sizes are approximately an order of magnitude smaller than conventional solvent dispersions.

The couplers for use in the microprecipitated dispersions of this invention preferably have a log P of greater than or equal to about 10, more preferably greater than or equal to about 12. The log P parameter is a well-known measurement of the solubility of a compound in aqueous liquids compared to its solubility in a nonpolar organic solvent (octanol). The log P parameter is further described, along with data for organic compounds, in C. Hansch & T. Fujita, J. Am. Chem. Soc., 86, 1616-25 (1964) and A. Leo & C. Hansch, *Substituent* 3 0 Constants for Correlation Analysis in Chemistry and Biology, Wiley, New York (1979), the disclosures of which are incorporated herein by reference. As disclosed in copending, commonly assigned USSN 08/634,491, filed Apr. 18, 1996, the disclosure of which is incorporated by reference herein, if the log P of a precipitated coupler is below about 10, the dispersion may not exhibit sufficient particle size stability upon storage.

Couplers having a high log P may be so highly hydrophobic that it is difficult to measure their water solubility using standard techniques. Such compounds preferably have a solubility in water of less than 1.0 $\mu$g/mL. In such cases, cLogP is a useful means to characterize their hydrophobicity, where cLogP is the logarithm of the value of the octanol/water partition coefficient (P) of the compound calculated using MedChem, version 3.54, a software package available from the Medicinal Chemistry Project, Pomona College, Claremont, Calif. cLogP is a parameter which is highly correlated with measured water solubility for compounds spanning a wide range of hydrophobicity.

The microprecipitated coupler dispersions of the invention are typically combined with a silver halide emulsion formed by any conventional means and then, after addition of water and hydrophilic colloid as needed to form the proper coating emulsion, are coated to form a photographic element.

The aqueous phase of the dispersions of the invention preferably comprises gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly (vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The water miscible auxiliary solvent for dissolving the hydrophobic coupler may be any solvent capable of dissolving the coupler without decomposing the coupler. Suitable solvents include methanol, propanol, isopropyl alcohol, and butyl alcohol.

Preferred surfactants for use in forming the dispersions of the invention are any anionic surfactant having a sulfate or sulfonate head group. The head group is the group on the surfactant that extends away from the particle into the water in which the particles disperse. The other portion of the surfactant is a hydrophobic group of, e.g., 8 to 20 carbons that will lie on the surface of the coupler particle. The sulfate or sulfonate group may be represented as an $SO_3M$ or $OSO_3M$ moiety where M represents a cation. M most commonly is sodium. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate. Typical of surfactants suitable for use in forming the dispersions of the invention are those as follows:

$C_{12}H_{25}OSO_3Na$ A-1

$C_{14}H_{29}OSO_3Na$ A-2

$C_{12}H_{25}CONHCH_2CH_2OSO_3Na$ A-3

$C_{12}H_{25}SO_3Na$ A-4

$C_{14}H_{29}SO_3Na$ A-5

$NaO_3S-CH(CH_2COOC_8H_{17})-COOC_8H_{17}$ A-6

A-7

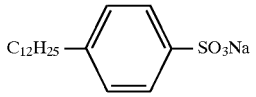

A-8

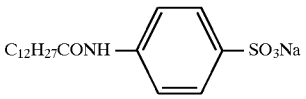

A-9

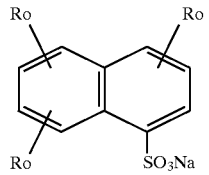

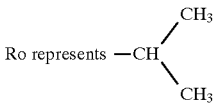

-continued

A-10

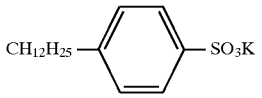

A-11

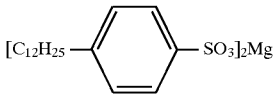

A-12 A mixture of di-isopropyl and tri-isopropyl naphthalene sodium sulfonate. The ratio of the di-isopropyl to the tri-isopropyl compound is between about 0.25 and about 2.0.

A-13

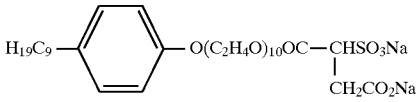

A-14

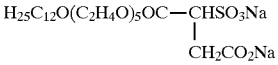

A-15

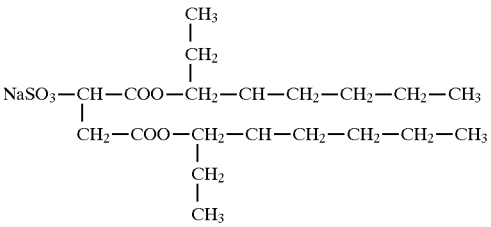

The coupler dispersions of the invention can be used in any of the ways and in any of the combinations known in the art. Typically, the invention materials are combined with a silver halide emulsion and the mixture is coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

It may be desirable to include a high molecular weight hydrophobe or "ballast" group in the component molecule to control the migration of various components. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer, such as described in *Research Disclosure*, November 1992, Item 34390. It is also specifically contemplated to use dispersions according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described , for example, in Sections VI–IX. Layers and layer arrangements, color negative and color positive features, scan facilitating features. supports, exposure and processing can be found in Sections XI–XX. The materials of the invention may also be used in conjunction with the materials described in *Koukai Gihou No.* 94-6023, Hatsumei Kyoukai, March 1994, available from the Japanese Patent Office, the disclosure of which is incorporated herein by reference.

High dye-yield couplers in accordance with the invention may be used exclusively or in combination with conventional two- or four-equivalent couplers. such conventional couplers may also comprise various cyan, magenta, yellow, or other dye-forming coupler moieties such as disclosed in the various patents and publications referenced above. To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. It may be useful to use a combination of couplers any of which may contain known ballasts or coupling-off groups such as those described in U.S. Pat. Nos. 4,301,235; 4,853,319 and 4,351,897.

It is also contemplated that dispersions of the invention may also be advantageously used with the materials and processes described in an article titled "Typical and Preferred Color Paper, Color Negative, and Color Reversal Photographic Elements and Processing," published in *Research Disclosure*, February 1995, Volume 370.

The invention materials may further be used in combination with a photographic element containing image-modifying compounds such as "Developer Inhibitor-Releasing" compounds (DIR's). DIR's useful in conjunction with the compositions of the invention are known in the alt and examples are described in U.S. Pat. Nos. 3,137,578; 3,148,022; 3,148,062; 3,227,554; 3,384,657; 3,379,529; 3,615,506; 3,617,291; 3,620.746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 15 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

Especially useful for use with this invention are tabular grain silver halide emulsions. Suitable tabular grain emulsions can be selected from among a variety of conventional teachings, such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; 5,061,616; and 5,320,938.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Specifically contemplated and preferred are Se and Ir doped tabular emulsions as described in U.S. Pat. No. 5,164,292. Usage of the invention in combination with thin layers as described in U.S. Pat. No. 5,322,766 is also specifically contemplated and preferred.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and 5,492,802, in conjunction with elements of the invention.

The method of the invention provides for the imagewise exposure of a photographic element of the invention followed by contacting the element with a color developing chemical to form a color image. Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image. It is an advantage of the invention that higher dye densities and contrasts may be obtained for microprecipitated dispersions relative to conventionally dispersed couplers, allowing for shorter development times and/or the use of lower material coating levels.

Preferred color developing agents for use in accordance with the invention are p-phenylenediamines such as: 4-amino-N,N-diethylaniline hydrochloride; 4-amino-3-methyl-N,N-diethylaniline hydrochloride; 4-amino-3-methyl-N-ethyl-N-(b-(methanesulfonamido ethyl)aniline sesquisulfate hydrate; 4-amino-3-methyl-N-ethyl-N-(b-hydroxyethyl)aniline sulfate; 4-amino-3-b-(methanesulfonamido)ethyl-N,N-diethylaniline hydrochloride; and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any photographically useful substituents. Usually the further substituent will have less than 30 carbon atoms and typically less than 20 carbon atoms.

Example 1

This example illustrates the effect of the microprecipitation method on the photographic activity of the very high dye yield (VHDY) coupler C1.

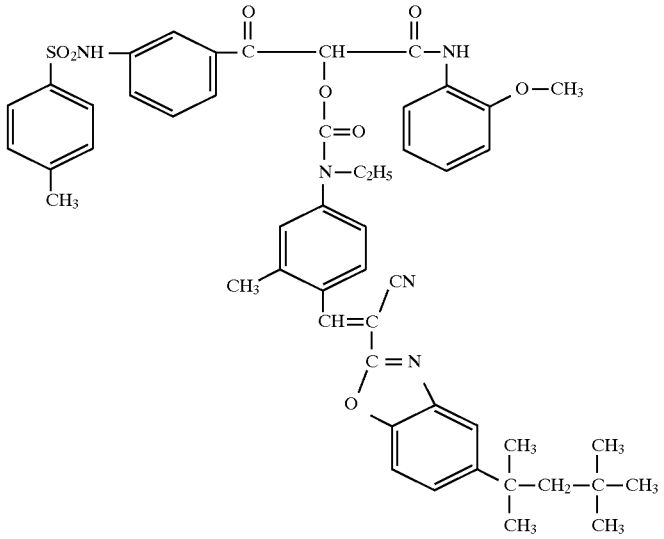

C1 clogP = 12.9

A microprecipitated dispersion of C1 was prepared in the following manner. One gram of C1 was dissolved in 1.6 mL of n-propanol with heating. 2.8 mL of 1 M sodium hydroxide was then added and the mixture cooled to room temperature. A surfactant solution was prepared by dissolving one gram of poly(vinylpyrrolidone) Kollidon 25 from BASF and 0.18 grams of sodium dodecyl sulfate in 34.4 mL of water. The surfactant solution was then slowly pipetted into the solution of C1 in propanol and aqueous sodium hydroxide. The pH of this mixture was adjusted to about 6.0 by the addition of a 15% solution of acetic acid in water causing microprecipitation of the coupler C 1. The resulting microprecipitated dispersion was poured into a dialysis bag and washed for 2 hr to remove propanol.

A conventional homogenized oil-in-water dispersion of C1 was prepared in the following manner for comparison. 0.75 grams of C1 was combined with 0.38 grams of dibutyl phthalate and 4 mL of ethyl acetate to constitute the oil phase. The aqueous phase was prepared by combining 0.23 grams of a 10% solution Alkanol XC, 12 grams of a 12.5% solution of Type IV gelatin and 11.64 grams of water. The aqueous phase was added to the oil phase and the mixture was stirred. This was then passed three times through a colloid mill. The ethyl acetate was evaporated from the resulting dispersion by stirring on a hot plate.

These dispersions were combined with photographic silver halide emulsion and coated on a film support at a laydown of 0.81 g/m$^2$ Ag and 0.11 g/m$^2$ coupler. The following format was employed to prepare inventive and comparative samples containing the coupler dispersions for testing:

| | |
|---|---|
| Layer 2 | Gelatin 5.38 g/m$^2$ |
| | Hardener 1,1'-(methylene bis(sulfonyl)bis-ethene 2% of total gelatin |
| | Spreading agent 1% of total volume |
| Layer 1 | Gelatin 2.69 g/m$^2$ |
| | Emulsion - tabular silver iodobromide 1.3 × 0.2 $\mu$m, 4 mole % iodide at 0.81 g/m$^2$ Ag + |
| | Image Coupler at 0.11 g/m$^2$ |
| | Spreading agent 1% of total volume |
| | Film base with Remjet or Grey Silver antihalation layer |

35 mm strips from the coating were exposed to blue light through a standard 21 step tablet and processed with the C-41 process chemistry with a development time of 45 seconds (substantially less than standard commercial development times of about 3 minutes). The D logE sensitometric curves of the processed strips are shown in FIG. 1. [It is clear that the method of the invention results in far greater activity], even with very short development times, as indicated by a higher contrast and density (Dmax) for the microprecipitated dispersion as demonstrated in the Figure.

Example 2

This example illustrates the effect of the microprecipitation method on the photographic activity of another very high dye yield (VHDY) coupler C2.

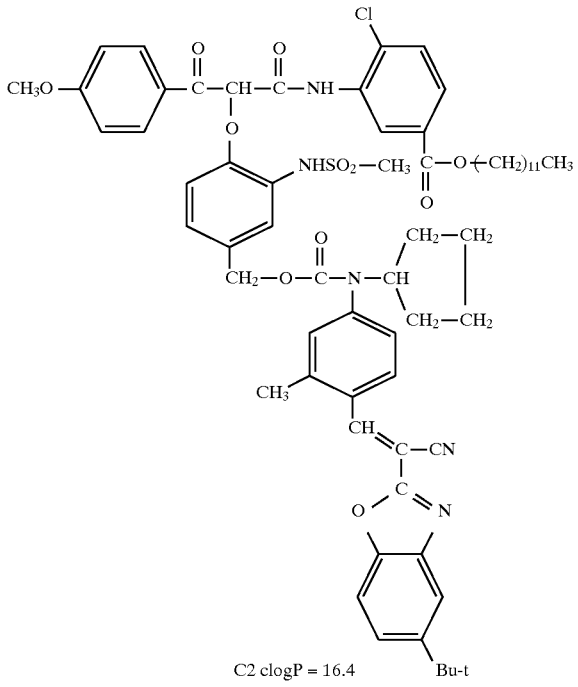

C2 clogP = 16.4

A microprecipitated dispersion of C2 was prepared in the following manner. 0.2 grams of C2 was dissolved in 0.42 mL of n-propanol and 0.21 mL of 1 M aqueous sodium hydroxide solution upon heating. The solution was then allowed to cool at room temperature. A surfactant solution was prepared by combining 0.1 grams of poly(vinylpyrrolidone) Kollidon 25 from BASF with 0.04 grams of sodium dodecyl sulfate and 6.94 grams of water. The surfactant solution was added slowly to the solution of coupler in propanol and sodium hydroxide with stirring. The pH of this mixture was adjusted to about 5.0 using a 15% solution of acetic acid in water causing microprecipitation of the coupler C2. The resulting microprecipitated dispersion was poured into a dialysis bag and washed for 2 hr to remove propanol.

A conventional homogenized oil-in-water dispersion of C2 was prepared in the following manner for comparison. 100 grams of C2 was dissolved in 300 grams of ethyl acetate to constitute the oil phase. The aqueous phase was prepared by dissolving 285.8 grams of a 35% solution of Type IV gelatin and 150 grams of a 10% solution of surfactant Alkanol XC in 814.2 grams of water. The aqueous phase was combined with the oil phase and the mixture was passed five times through a colloid mill. The ethyl acetate was then removed by evaporation.

Figure 2:
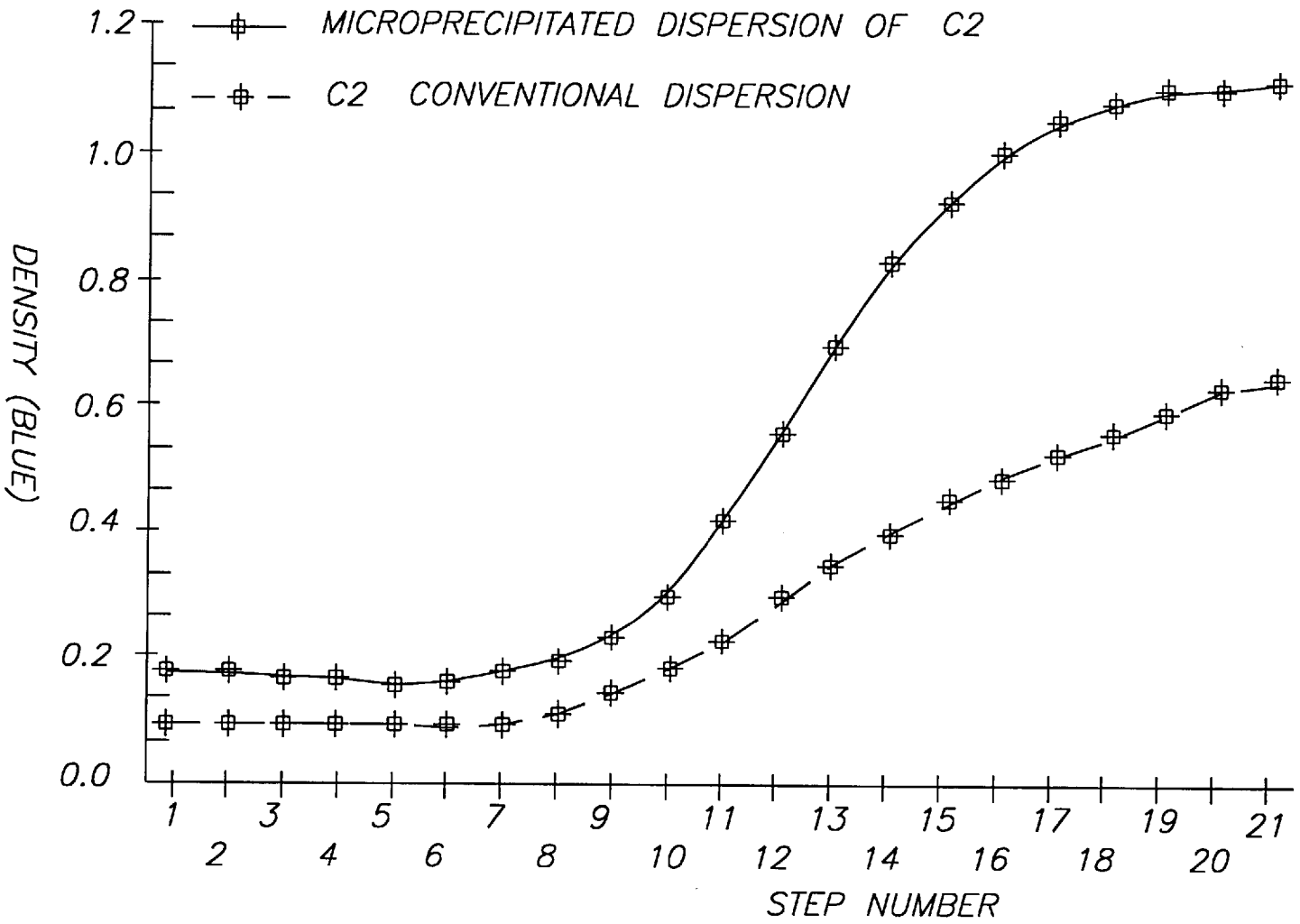

The dispersions were combined with photographic silver halide emulsion and coated on a film support at a laydown of 0.81 g/m$^2$ Ag and 0.27 g/m$^2$ coupler similarly as in Example 1. 35 mm strips from the coating were exposed to blue light through a standard 21 step tablet and processed with the C-41 process chemistry with a development time of one minute and seven seconds. The D logE sensitometric curves of the processed strips are shown in FIG. 2. Once again it is clear that the invention results in significantly greater activity than the control, as indicated by a higher contrast and density (Dmax).

The above examples demonstrate significantly improved photographic activity for the microprecipitated high dye yield coupler dispersions of the invention relative to conventional oil-in-water dispersions of such couplers, wherein relatively short development times of 45 seconds (Example 1) and 1 minute seven seconds (Example 2) are used. Additional experiments have been conducted which also demonstrate similar results at conventionally longer development times (e.g., development times of 3 minutes 15 seconds for C-41 processing chemistry).

The preceding examples are set forth to illustrate specific embodiments of this invention and are not intended to limit the scope of the materials or combinations of this invention. Additional embodiments and advantages within the scope of the claimed invention will be apparent to one skilled in the art.

What is claimed is:

1. A photographic element comprising a support bearing a photographic silver halide emulsion layer having associated therewith an aqueous micro-precipitated dispersion of a high dye-yield coupler precipitated from an auxiliary solvent solution by pH or solvent shift, the coupler having the formula:

$$\text{COUP—(T)}_m\text{—L—DYE}$$

where COUP is the coupler moiety of the coupler capable of reacting at the coupling position with oxidized color developer to form a first dye, T is one or more timing groups with m=0, 1 or 2, L is a linking group selected from the group consisting of —OC(O)—, —OC(S)—, —SC(O)—, —SC(S)—, or —OC(=$NSO_2R$)—, where R is a substituted or unsubstituted alkyl or aryl group, and DYE is a second dye or precursor thereof comprising an electrically neutral chromophore.

2. The element of claim 1 wherein COUP represents an image dye-forming coupler moiety which forms a cyan, magenta, yellow or black image dye upon reacting with oxidized developer.

3. The element of claim 2 wherein COUP represents a yellow image dye-forming coupler moiety.

4. The element of claim 3 wherein COUP is an open chain ketomethylene compound.

5. The element of claim 1, wherein COUP represents a ballasted image dye-forming coupler moiety which forms a ballasted image dye upon reacting with oxidized developer, and DYE represents a ballasted dye which provides substantially the same hue as the dye formed by COUP.

6. The element of claim 5, wherein COUP represents a yellow dye forming coupler moiety and DYE represents a yellow dye.

7. The element of claim 6 wherein DYE comprises a methine dye moiety.

8. The element of claim 1 wherein DYE comprises a methine dye moiety.

9. The element of claim 1 wherein L is —OC(O)—.

10. The element of claim 1 wherein the coupler has a log P of greater than or equal to about 10.

11. A method of forming a photographic emulsion comprising photographic silver halide grains having associated therewith a dispersion of a high dye-yield coupler having the formula:

$$\text{COUP—(T)}_m\text{—L—DYE}$$

where COUP is the coupler moiety of the coupler capable of reacting at the coupling position with oxidized color developer to form a first dye, T is one or more timing groups with m=0,1 or 2, L is a linking group selected from the group consisting of —OC(O)—, —OC(S)—, —SC(O)—, —SC(S)—, or —OC(=$NSO_2R$)—, where R is a substituted or unsubstituted alkyl or aryl group, and DYE is a second dye or precursor thereof comprising an electrically neutral chromophore; the method comprising forming a microprecipitated coupler dispersion of the high dye-yield coupler by precipitation from an auxiliary solvent solution by pH or solvent shift, and combining the precipitated coupler dispersion with a silver halide emulsion wherein the coupler dispersion particles are precipitated to an average particle size of from 0.01 to 0.05 micron.

12. The method of claim 11 wherein the coupler has a log P of greater than or equal to about 10.

13. A method of forming a color image in a photographic element as described in claim 1 which has been imagewise exposed, comprising contacting said element with a color developer to generate oxidized color developing agent in an imagewise manner, and forming two dyes for each high dye-yield coupler molecule which is reacted with oxidized color developing agent.

14. The method of claim 13, wherein COUP represents a ballasted image dye-forming coupler moiety which forms a ballasted image dye upon reacting with oxidized developer, and DYE represents a ballasted dye which provides substantially the same hue as the dye formed by COUP.

15. The method of claim 14, wherein the dye represented by DYE has a $\lambda_{max}$ within 25 nm of the $\lambda_{max}$ of the dye formed upon reaction of COUP with the oxidized color developer, wherein $\lambda_{max}$ represents the wavelength of maximum light absorbance of the dye in the photographic element.

16. The method of claim 15, wherein COUP represents a yellow dye forming coupler moiety and DYE represents a yellow dye.

17. The method of claim 16, wherein DYE comprises a methine dye moiety.

18. The method of claim 13 wherein the photographic element microprecipitated coupler dispersion has an average particle size of from 0.01 to 0.05 micron.

* * * * *